US011959176B2

(12) United States Patent
Derderian

(10) Patent No.: US 11,959,176 B2
(45) Date of Patent: Apr. 16, 2024

(54) METALLIC COATING AND METHOD

(71) Applicant: PBTT, INC., Newburgh, IN (US)

(72) Inventor: Alex Derderian, Grand Blanc, MI (US)

(73) Assignee: PBTT, INC., Newburgh, IN (US)

( * ) Notice: Subject to any disclaimer, the term of this patent is extended or adjusted under 35 U.S.C. 154(b) by 53 days.

(21) Appl. No.: 17/091,781

(22) Filed: Nov. 6, 2020

(65) Prior Publication Data

US 2021/0140050 A1 May 13, 2021

Related U.S. Application Data

(60) Provisional application No. 62/932,078, filed on Nov. 7, 2019.

(51) Int. Cl.

| | |
|---|---|
| ***C23C 18/16*** | (2006.01) |
| ***C22C 32/00*** | (2006.01) |
| ***C23C 18/20*** | (2006.01) |
| ***C23C 18/36*** | (2006.01) |
| *C22C 19/03* | (2006.01) |

(52) U.S. Cl.

CPC ..... *C23C 18/1633* (2013.01); *C22C 32/00* (2013.01); *C22C 32/0084* (2013.01); *C23C 18/1662* (2013.01); *C23C 18/2086* (2013.01); *C23C 18/36* (2013.01); *C22C 19/03* (2013.01); *C22C 32/0089* (2013.01); *C23C 18/1646* (2013.01); *Y10T 428/12056* (2015.01); *Y10T 428/12625* (2015.01)

(58) Field of Classification Search

None

See application file for complete search history.

(56) References Cited

U.S. PATENT DOCUMENTS

2007/0281176 A1* 12/2007 Palumbo ..... C23C 28/027 473/578
2014/0374267 A1* 12/2014 Monteiro ..... C25D 9/04 205/104

FOREIGN PATENT DOCUMENTS

CN 106637158 A * 5/2017 ..... C23C 18/1666
WO WO-2012012636 A1 * 1/2012 ..... C23C 30/00

* cited by examiner

*Primary Examiner* — Seth Dumbris

(74) *Attorney, Agent, or Firm* — Carlson, Gaskey & Olds, P.C.

(57) ABSTRACT

A metallic coating includes a first metal, a second metal, phosphorous, and graphene nanoparticles. The first metal may be nickel and the second metal may be a refractory metal, such as tungsten, rhenium, molybdenum, niobium, tantalum, or mixtures thereof. The metallic coating may have, by weight, 1.0% to 40.0% of refractory metal, 1.0% to 20.0% of phosphorous, 0.01% to 5.0% of the graphene nanoplatelets, and a remainder of the nickel.

3 Claims, 3 Drawing Sheets

METALLIC COATING AND METHOD

BACKGROUND OF THE INVENTION

Field of the Invention

The present disclosure relates to metal plating solutions and to a method for producing the metal plating solutions. The present disclosure further relates to metallic coatings and to a method for forming the metallic coatings.

Description of the Related Art

Plating is a process used for deposition of metals upon a surface of a substrate from an aqueous solution (electrolyte) containing, among other things, metal salts. The plating deposition process can be an electrolytic process, where an external current is applied to the substrate, or can be accomplished purely through a chemical reaction. This latter chemically induced plating process is known as electroless, or autocatalytic, plating.

Electroless plating involves the use of several simultaneous electrochemical reactions that occur in a plating bath to create a charge bias between the aqueous plating solution and the substrate on which the metal ions are deposited. Hydrogen is released as a result of reduction at the substrate surface by a supplied reducing agent, typically sodium hypophosphite, creating a negative charge on the surface of the part. A number of electroless plating processes work to deposit different metals onto the surface of a part.

The most common form of a deposit from an electroless process is a metal phosphorous alloy, commonly nickel phosphorous. Nickel phosphorous can be deposited with varying concentrations of phosphorous depending on the target properties of the deposit. Nickel phosphorous metal coatings have low as-plated coating stress, high hardness, and high corrosion resistance. However, applications involving extreme environments can deteriorate nickel phosphorous metal coatings during use because of their low melting temperature.

Refractory metals are well suited for extreme environments due to their high hardness, high heat resistance, and corrosion resistance. Alloying refractory metals with nickel and nickel alloys in plating processes substantially improves the robustness of the deposit. Specifically, tungsten or rhenium can be reduced with phosphorous and alloyed with nickel to substantially increase the heat resistance and corrosion resistant properties of the resulting deposited alloys. Since the cost per kilogram of rhenium is exceedingly high, preventing it from being a cost-effective metal addition to an electroless plating bath, this proposal focuses on the fusion of tungsten and nickel in an electroless process.

Pearlstein and Weightman experimented with nickel phosphorous deposits alloyed with tungsten and rhenium at the Pitman-Dunn Research Laboratories, Frankford Arsenal. They demonstrated that the incorporation of tungsten alloyed with a nickel phosphorous during electroless plating yields a deposit with properties able to withstand accuracy and endurance firing requirements identified by the Army. The base formulations combining sodium tungstate with a commercial acid-citrate electroless nickel bath are described in Table 1.

TABLE 1

| Chemical Name | Chemical Formula | Concentration |
|---|---|---|
| Nickel Sulfate and Deionized Water | $NiSO_4 + .6H_20$ | 7 g/l |
| Sodium Tungstate and Deionized Water | $Na_2WO_4 + .2H_20$ | 40 g/l |
| Sodium Hypophosphite and Deionized Water | $NaPO_2H_2 + .H_20$ | 10 g/l |

Nanotechnology additives, including carbides, such as titanium carbide and silicon carbide, nitrides, such as aluminum nitride and titanium nitride, and diamond nanoparticles, such as synthetic nanodiamonds and detonation nanodiamonds, can be used to improve the grain structure of a metal coating. These nanotechnology additives can improve material properties, including, but not limited to, increasing hardness, tensile strength, thermal conductivity, and chemical stability, translating to greater wear and corrosion resistance. Unfortunately, the cost per kilogram of diamond nanoparticles is exceedingly high, preventing these from being a cost-effective metal addition to an electroless plating bath. Accordingly, there is a need for a cost-effective metal coating for substrates that can be added to an electroless plating bath to achieve superior results at a significantly reduced cost.

SUMMARY OF THE INVENTION

It is therefore an object of the present invention to provide an improved metal plating solution and a method for producing the metal plating solution. It is a further object of the invention to provide an improved metallic coating and a method for forming the metallic coating on a substrate where the metallic coating is deposited from the metal plating solution onto the substrate.

The metal plating solution and the metallic coating deposited from the metal plating solution includes a first source of metal ions, a second source of metal ions, a reducing agent, and carbon nanoparticles where the carbon is in the form of graphene. The carbon nanoparticles in the form of graphene can also be referred to herein as graphene nanoparticles, distinguishing the graphene nanoparticles included in the disclosed metal plating solution and metallic coating from nanoparticles made from other non-graphene allotropes of carbon. For example, it would be understood that carbide nanoparticles and diamond nanoparticles are made from non-graphene allotropes of carbon, and as such, are specifically not included in the group of carbon nanoparticles referred to herein as graphene nanoparticles.

The base formulations of Pearlstein and Weightman were used to develop a plating process capable of depositing a nickel phosphorous coating with a high percentage of tungsten in mass production. The concentration of sodium tungstate in the electroless plating solution was increased from 40 g/l to 80 g/l. The pH of the plating bath was increased to 8.9 (0.7 higher than Pearlstein and Weightmans's formulation). The temperature of the solution was increased to 180° F. A stainless steel tank equipped with work bar and air agitation was used to reduce deposit defects. Optimization of this process yielded a commercial grade solution with a high concentration of tungsten as summarized in Table 2.

TABLE 2

| | pH | Temperature (° F.) | Nickel (%) | Phosphorous (%) | Tungsten (%) |
|---|---|---|---|---|---|
| Deposit | 8.9 | 180 | 87.34 | 6.68 | 5.98 |

Heat treatment of the deposit was conducted using a range of cycle profiles to test variations in time, temperature, and atmosphere. An optimized process was identified for 60 minutes at 750° F. in a 99.99% argon inert atmosphere. The resulting structure was inspected via EDS to characterize the deposit (FIG. 3). Inspection results indicated that nickel-phosphorous and nickel-tungsten precipitated in the deposit to form a new deposit structure with improved material properties. The deposit was found to be uniformly distributed over the substrate without visible micro-cracking. Microhardness readings and Taber Wear Index demonstrated a substantial improvement to mechanical wear resistance when compared with the as-plated deposit. The coating melting temperature was tested using a ceramic furnace. Coating delamination was tested using a propane burner. The coating was found to adhere to the substrate at temperatures exceeding 2000° C.

Graphene nanoplatelets are a type of commercial grade nanoparticle that has been investigated for its ability to refine coating structures and increase wear and thermal resistance in electroless nickel plating. Graphene nanoplatelets can be purchased in cylindrical shapes measuring 2-4 nm in size. The small size, narrow size distribution, and regular shape of these particles are factors contributing to creating a plating deposit with homogenous properties. Graphene nanoplatelets can be functionalized with a variety of functional groups to create a net zeta potential on the surface of the particle. The net negative zeta potential graphene nanoplatelets are attracted to the net positive metal ions and co-deposit onto the surface of the substrate. This co-deposition through electrical attraction is the primary cause of a homogeneous nanocomposite deposit.

Graphene nanoplatelets were added to the nickel-tungsten electroless plating solution identified in Table 1. Graphene concentrations tested ranged from 0.1% to 1.0%. Air sparging was added to the stainless steel plating tank to keep the graphene nanoplatelets in suspension. The bath temperature was increased from 180° F. to 185° F. The pH of the bath was reduced to 8.7. The resulting deposit was heat treated, using the same protocol to precipitate phosphorous and tungsten in the deposit. Optimization of this process yielded a commercial grade solution with able to produce nickel-tungsten-graphene alloy as summarized in Table 3.

TABLE 3

| | pH | Temperature (° F.) | Nickel (%) | Phosphorous (%) | Tungsten (%) | Graphene (%) |
|---|---|---|---|---|---|---|
| Deposit | 8.7 | 185° F. | 87.14% | 6.68% | 5.98% | 0.2% |

Bonding graphene nanoplatelets directly to the nickel-phosphorous and nickel-tungsten precipitants substantially increased the microhardness of the material while reducing the coefficient of friction, leading to a reduction in the Taber Wear Index. The observed increase in the melting temperature was attributed to the superior thermal properties inherent to the graphene nanoplatelets. A comparison of the nickel-tungsten (Ni—W) and nickel-tungsten-graphene (Ni-W-G) deposit properties is provided in Table 4.

TABLE 4

| | Ni—W | Ni—W—G |
|---|---|---|
| Process Type | Electroless | Electroless |
| Process Cost | Medium | Medium |
| Environmentally Hazardous | No | No |

TABLE 4-continued

| | Ni—W | Ni—W—G |
|---|---|---|
| Coating Thickness Minimum | 0.0003 in. | 0.0003 in. |
| Coating Thickness Maximum | No Max | No Max |
| Coating Thickness Tolerance | 0.0001 in. | 0.0001 in. |
| Microhardness | 1080 HV | 1120 HV |
| Coefficient of Friction | 0.15 | 0.10 |
| Taber Wear Index | 5.1 mg/1000 cycles | 2.8 mg/1000 cycles |
| Corrosion Resistance | High | High |
| Color Ranges | Silver-Gold | Silver-Gold |
| Adhesion to Substrate | High | High |

In a non-limiting example, the metal of the first source of metal ions is nickel, which can be provided to the metal plating solution as nickel sulfate, nickel chloride, and/or a mixture thereof. In a non-limiting example, the metal of the second source of metal ions is a refractory metal and/or mixture of refractory metals. For example, the metal of the second source of metal ions can be selected from a group consisting of tungsten, rhenium, molybdenum, tantalum, and mixtures thereof. In one example, the metal of the second source of metal ions is tungsten, which is advantaged by a more affordable cost, for example, relative to rhenium, due to a wider range of stable supply of tungsten worldwide. In a non-limiting example, the reducing agent includes sodium hypophosphite, which, in the electroless plating solution, reacts with the first and second sources of metal ions to deposit ultra-fine metal phosphorous crystallites on the surface of a substrate immersed in the plating solution, to form a metallic coating on the surface of the substrate. The metal plating solution described herein is composed such that, as the bath concentration increases in sodium hypophosphite, the structure of the metal phosphorous coating can change in structure, preventing intergranular corrosion in the metallic coating formed in the substrate. In conjunction with corrosion resistance, the metal phosphorous coating has a multitude of other benefits, including high hardness, high hot hardness, a low coefficient of friction, low thermal conductivity, and low thermal expansion. These properties combine to from a deposit with exceptional wear properties in standard and extreme environments.

In one example, the introduction of the second source of metal ions in the form of sodium tungstate into an electroless nickel bath alters the structure of the crystallites deposited in the metallic coating. The sodium hypophosphite reductions with nickel occurring in the plating solution described herein are accompanied by sodium tungstate reductions to create three main crystallite structures in the metallic coating, specifically, nickel phosphorous, nickel tungstate, and nickel phosphorous tungstate, where the phosphorous reduces tungsten preferentially to reducing nickel during the formation of the metallic coating. The introduction of these new constituent components creates a columnar coating structure. These columnar crystallites formed in the deposited metallic coating substantially improve the corrosion resistance, melting temperature, and hardness of the metallic coating, such that the metallic coating described herein is substantially advantaged by the columnar structure of the refractory crystallites formed therein.

The metallic coating further includes nanotechnology additives in the form of graphene nanoparticles, which can be used to improve the grain structure of a metal coating. The graphene nanoparticles present in the metallic coating described herein can increase material properties, including but not limited to hardness, tensile strength, thermal conductivity, and chemical stability, which translate to greater wear and corrosion resistance. Graphene nanoparticles are substantially more affordable relative to nanodiamonds, thus the metallic coating and methods described herein are advantaged by a reduced cost relative to metal coatings including nanodiamonds. Graphene nanoparticles, as that term is used herein, refer to nanoparticles which are graphene-based, that is, made from carbon in the form of graphene, such that the term graphene nanoparticles, as used herein, refers by non-limiting example to a group consisting of graphene nanoplatelets (GNPs), graphene oxide, and functionalized carbon nanotubes. In a preferred example, the metallic coating described herein includes graphene nanoparticles in the form of graphene nanoplatelets. Graphene nanoplatelets consist of small stacks of graphene and are also referred to herein as graphite nanoplatelets, or GNPs. When added to the solution, graphene nanoplatelets can increase electrical and thermal conductivity while creating a surface less susceptible to various acids and salt solutions and improving mechanical properties, including strength, stiffness, and hardness. In one example, carboxylate graphene nanoplatelets are included as nanoscale additives in the plating solution described herein. In one example, the overall thickness of the graphene nanoplatelet stack is in the range of about 1-20 nanometers. In one example, graphene nanoplatelets which are less than 4 nm thick, which can also be referred to herein as Grade 4 GNPs, are preferred.

According to one aspect of the invention, there is provided a metallic coating comprising: a first metal; a second metal; phosphorous; and carbon nanoparticles; wherein the carbon is in the form of graphene. The carbon nanoparticles may be selected from a group consisting of graphene nanoplatelets, graphene oxide, and functionalized carbon nanotubes. Alternatively, the carbon nanoparticles include graphene nanoplatelets. The graphene nanoplatelets have a stack thickness in the range of 1 to 10 nanometers, and preferably less than or equal to 4 nanometers. The graphene nanoplatelets have a particle diameter in the range of 1 to 20 nanometers, and preferably in the range of 1 to 10 nanometers. The graphene nanoplatelets include terminated graphene nanoplatelets and non-terminated graphene nanoplatelets. Alternatively, graphene nanoplatelets are terminated by attachment of a functional group selected from the group consisting of a carboxyl acid (COOH), an amino radical (NH2), dinitrogen (N2), fluorine (f), oxygen (O+), silicon (Si), and mixtures thereof. The graphene nanoplatelets exhibit a positive net zeta potential.

According to one preferred embodiment of the invention, the first metal is nickel; and the second metal is a refractory metal. The second metal is selected from a group consisting of tungsten, rhenium, molybdenum, niobium, tantalum, and mixtures thereof. The refractory metal may be tungsten. The composition of the metallic coating includes crystallite structures selected from a group comprising nickel phosphorous, nickel tungstate, nickel phosphorous tungstate, and mixtures thereof. The crystallite structures include columnar structures.

According to a further embodiment of the invention, the metallic coating may further comprise a third metal. The third metal is selected from the group consisting of molybdenum, rhenium, and mixtures thereof. Alternatively third metal may be boron.

The carbon nanoparticles may include graphene nanoplatelets; and the composition of the metallic coating includes graphene nanoplatelets in the range of 0.01% to 5.0% by weight of the metallic coating, and preferably in the range of 0.05% to 1.5% by weight of the metallic coating, or 0.05% to 1.0% by weight of the metallic coating. The composition of the metallic coating may further include tungsten in the range of 1.0% to 40.0% by weight of the metallic coating. The composition of the metallic coating may include phosphorous in the range of 1.0% to 20.0% by weight of the metallic coating.

A second aspect of the invention is a method for coating a substrate comprising the steps of: immersing a substrate in a plating bath comprising an electroless metal plating solution; depositing, on a surface of the immersed substrate, a metallic coating comprising a first metal; a second metal; phosphorous; and carbon nanoparticles; wherein the carbon is in the form of graphene; and removing the substrate from the plating bath; wherein the substrate including the metallic coating deposited on the surface form a coated substrate.

The first metal is nickel; the second metal is tungsten; and the carbon nanoparticles include graphene nanoplatelets. The composition of the metallic coating includes crystallite structures selected from the group comprising nickel phosphorous, nickel tungstate, nickel phosphorous tungstate, and mixtures thereof. The crystallite structures include columnar structures. The composition of the metallic coating includes graphene nanoplatelets in the range of 0.01% to 5.0% by weight of the metallic coating, and preferably in the range of 0.05% to 1.5% by weight of the metallic coating, or 0.05% to 1.0% by weight of the metallic coating. The composition of the metallic coating includes phosphorous in the range of 1.0% to 20.0% by weight of the metallic coating. The composition of the metallic coating includes tungsten in the range of 1.0% to 40.0% by weight of the metallic coating.

The substrate may made of a metal-based material, wherein the metal is selected from the group consisting of iron, aluminum, magnesium, titanium, zinc, copper, carbon, nickel, chromium, trace elements and mixtures thereof. Alternatively, the substrate may be made of a steel alloy, preferably one selected from the group consisting of 4140 series steels. The steel alloy may be selected from the group consisting of steel alloys containing chromium, molybdenum and vanadium. Alternatively, the substrate is made of a non-metallic material, or a polymer-based material.

The method may further comprise the step of cleaning the substrate prior to immersing the substrate in the plating bath. The step of cleaning the substrate includes removing a coating or oxide layer from the surface of the substrate. The coating may be a corrosion resistant agent.

The method may further comprising at least one of: removing an oxide layer from the surface of the substrate prior to immersing the substrate in the plating bath; etching an oxide layer on the surface of the substrate prior to immersing the substrate in the plating bath; and activating the surface of the substrate. The at least one of removing, etching, and activating may be performed without toxification of the substrate.

The method may further comprise applying a mask to an unplated portion of the surface prior to immersing the substrate in the plating bath; and wherein the mask prevents formation of the metallic coating on the unplated portion of the surface during immersion of the substrate in the plating bath. The method may further comprise removing the substrate from the plating bath; and removing the mask from the unplated portion of the surface. The method may further comprise the step of applying an auxiliary coating to the surface of the substrate after removing the mask. The auxiliary coating is selected from the group consisting of a liquid paint, a conversion coating, an organic coating, and an electrophoretic deposition coating (e-coating).

The method may further comprise applying a coating mask to a portion of the surface of the substrate; wherein the portion of the surface to which the coating mask is applied defines a masked portion; and wherein the coating mask is applied prior to applying the auxiliary coating. The method may further comprise removing the coating mask from the masked portion; and wherein the coating mask is reusable. The plating mask may be reusable.

The method may further comprise the step of applying a heat treatment to the plated substrate; wherein the heat treatment is applied after coating the plated substrate. The heat treatment may include heating the plated substrate to a baking temperature in the range of 250 to 550 degrees Celsius. The heat treatment may further include heating the plated substrate in a protective environment, which may include at least one of argon, nitrogen, and carbon gas. The step of applying the heat treatment may further include: heating the plated substrate at the baking temperature for a predetermined cycle time which is greater than a minimum cycle time; wherein the minimum cycle time is the time required to uniformly heat the plated substrate to the baking temperature. The predetermined cycle time is the time required to precipitate new grain structures in the metallic coating.

The method may further include the step of air cooling the plate substrate after heating, and drying the plated substrate prior to applying the heat treatment. The method may further include the step of heating a chamber to the baking temperature; and positioning the plated substrate in the chamber. The method may further include the step of removing the plating mask from the plated substrate prior to applying the heat treatment. The heat may be applied to a plurality of plated substrates; positioning each of the plurality of plated substrates in the chamber such each plated substrate is spatially separated in the chamber from each other plated substrate of the plurality of plated substrates.

A third aspect of the invention is an electroless metal plating solution comprising: a first source of metal ions; a second source of metal ions; a reducing agent; and carbon nanoparticles; wherein the carbon is in the form of graphene. The metal of the first source of metal ions may be nickel. The first source of metal ions may be selected from the group consisting of nickel sulfate, nickel chloride, and mixtures thereof. The purity of the first source of metal ions is at least 97%, and preferably is at least 99.9%.

The metal of the second source of metal ions may be selected from the group consisting of one or more refractory metals, and mixtures thereof. The concentration of the second source of metal ions is about 60 grams per liter (g/l) of the electroless metal plating solution. Alternatively, the metal of the second source of metal ions is selected from the group consisting of tungsten, rhenium, molybdenum, niobium, tantalum, and mixtures thereof. Yet another alternative is the metal of the second source of metal ions is selected from the group consisting of tungsten, rhenium, and mixtures thereof. Another alternative is that the metal of the second source of metal ions is tungsten.

The particle size of the second source of metal ions may be equal to or less than 100 mesh. The particle shape of the second source of metal ions is substantially spherical.

The electroless metal plating solution may further comprise a third source of metal ions. The metal of the third source of metal ions may be selected from the group consisting of molybdenum, rhenium, and mixtures thereof. Alternatively, the metal of the third source of metal ions is boron. The reducing agent may include phosphorous, or sodium hypophosphite. The reducing agent may include sodium hypophosphite; the first source of metal ions may be nickel sulfate; and the second source of metal ions may be sodium tungstate.

The carbon nanoparticles may exhibit a positive net zeta potential. The carbon nanoparticles are selected from the group consisting of graphene nanoplatelets, graphene oxide, and carbon nanotubes. The carbon nanoparticles are preferably graphene nanoplatelets. The graphene nanoplatelets have a stack thickness in the range of 1 to 20 nanometers, and preferably less than or equal to 4 nanometers. The graphene nanoplatelets have a particle diameter in the range of 1 to 20 nanometers, and preferably in the range of 1 to 10 nanometers.

The graphene nanoplatelets are terminated graphene nanoplatelets. Alternatively, the graphene nanoplatelets are non-terminated graphene nanoplatelets. The graphene nanoplatelets are terminated by attachment of a functional group selected from the group consisting of a carboxyl acid (COOH), an amino radical (NH2), dinitrogen (N2), fluorine (f), oxygen (O+), silicon (Si), and mixtures thereof. The graphene nanoplatelets may be delivered to the electroless metal plating solution in a dry powder form.

The electroless metal plating solution may further comprise a dispersing agent; wherein the graphene nanoplatelets are suspended in the dispersing solution.

In the electroless metal plating solution according to one example of the present disclosure, the concentration of the graphene nanoplatelets is about 0.05 grams per liter (g/l) of the electroless metal plating solution. The pH of the electroless metal plating solution is in the range of 2 to 11, preferably in the range of 4 to 9, and most preferably about 9.

A fourth aspect of the invention is a method for producing the electroless metal plating solution comprising: providing a base solution comprising: a first source of metal ions; and wherein the metal of the first source of metal ions is nickel; a reducing agent; wherein the reducing agent includes sodium hypophosphite adding a second source of metal ions to the base solution; wherein the metal of the second source of metal ions is selected from the group consisting of one or more refractory metals and mixtures thereof; adding carbon nanoparticles to the base solution; wherein the carbon is in the form of graphene; and mixing the base solution including the second source of metal ions and the carbon nanoparticles to produce the electroless metal plating solution.

The carbon nanoparticles may be added to the base solution in dry powder form, or as an aqueous dispersion. The step of mixing the electroless plating solution is performed at an ambient temperature. The may include the further step of heating the electroless plating solution to an operating temperature; wherein the operating temperature is greater than the ambient temperature. The operating temperature is preferably in a range of 185 to 190 degrees Fahrenheit.

The method may further include the step of adjusting the pH of the electroless metal plating solution in the range of 2 to 11, or preferably in the range of 4 to 9, or most preferably about 9. The concentration of the graphene nanoplatelets is about 0.05 grams per liter (g/l) of the electroless metal plating solution. The concentration of the second source of metal ions is about 60 grams per liter (g/l) of the electroless metal plating solution.

The method may further comprise the step of adding a third source of metal ions to the base solution; wherein metal of the third source of metal ions is selected from the group consisting of molybdenum, rhenium, and mixtures thereof. Alternatively, the method may further comprise the step of adding a third source of metal ions to the base solution; wherein metal of the third source of metal ions is boron.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
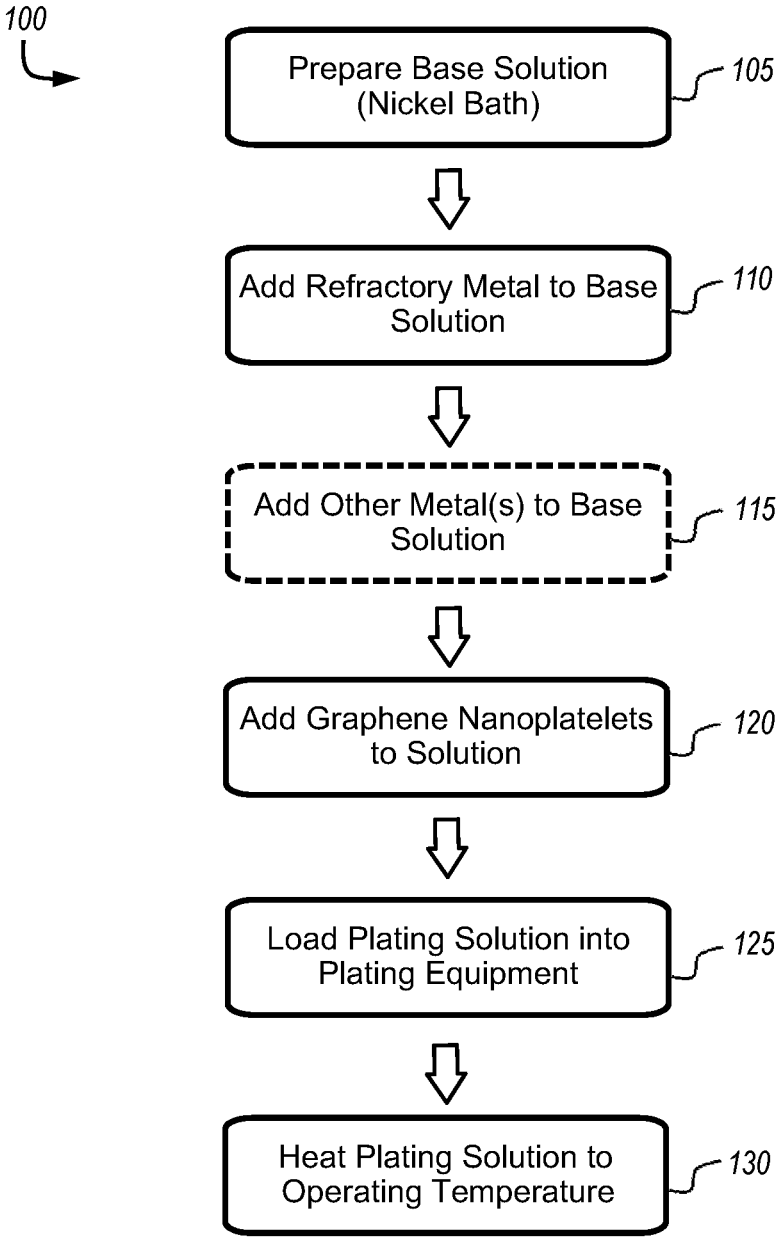
FIG. 1 is a flowchart of an exemplary method for preparing a metal plating solution as further described herein.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "a," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. Each value within a range and the endpoints of a range are hereby all disclosed as separate embodiments.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various configurations of an electroless metal plating solution, a method of producing the electroless metal plating solution, a metallic coating deposited from the metal plating solution, and a method for coating a substrate with the metallic coating, using the metal plating solution. The components and compositions of the disclosed embodiments, as described and illustrated herein, may be arranged and designed in a variety of different configurations. Thus, the following detailed description is not intended to limit the scope of the disclosure, as claimed, but is merely representative of possible embodiments thereof. For example, although the metallic coating and metal plating solution is depicted as being composed of nickel, tungsten, phosphorous and graphene nanoplatelets in the example descriptions and associated Figures, other configurations and compositions may be applied to provide various properties and characteristics in the resulting metallic coating. For example, refractory metals in addition to or other than tungsten can be included in the composition. Additional metals can be added to contribute and/or enhance properties such as heat resistance of and grain formation in the metallic coating. Further, in addition to graphene nanoplatelets, other forms of graphene-based nanoparticles, such as graphene oxide and/or carbon nanotubes may also be included in the compositions discussed herein.

In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. For example, the formation and production of graphene nanoplatelets is well understood in the art, as illustrated at least by Kim (U.S. Pat. No. 8,263,843B2) and Sanchez (U.S. Pat. No. 8,641,998B2). For example, the termination of graphene oxide using different types of termination is well understood in the art, as illustrated at least by Ho (U.S. Pat. No. 9,156,701B2). For example, the method for separation and functionalization of carbon nanotubes is well understood in the art, as illustrated at least by Strano (U.S. Pat. No. 7,887,774B2). Furthermore, the disclosure, as illustrated and described herein, may be practiced in the absence of an element that is not specifically disclosed herein.

A metal plating solution is described herein, the metal plating solution includes a first source of first metal ions, a second source of second metal ions, a reducing agent containing phosphorous, and carbon nanoparticles where the carbon is in the form of graphene, e.g., where the carbon nanoparticle is a graphene-based nanoparticle. The carbon nanoparticles made from carbon in the form of graphene can also be referred to herein as graphene nanoparticles, thus differentiating the graphene nanoparticles included in the metal plating solution described herein from non-graphene nanoparticles made from other non-graphene allotropes of carbon such as carbide and diamond. For example, it would be understood that carbide nanoparticles and diamond nanoparticles are made from non-graphene allotropes of carbon, and as such, are specifically not included in the group of carbon nanoparticles referred to herein as graphene nanoparticles. By way of illustrative example, the graphene nanoparticles included in the metal plating solution and metallic coating described herein are selected from the group consisting of graphene nanoplatelets (also referred to herein as graphite nanoplatelets), graphene oxide, and carbon nanotubes.

Figure 2:
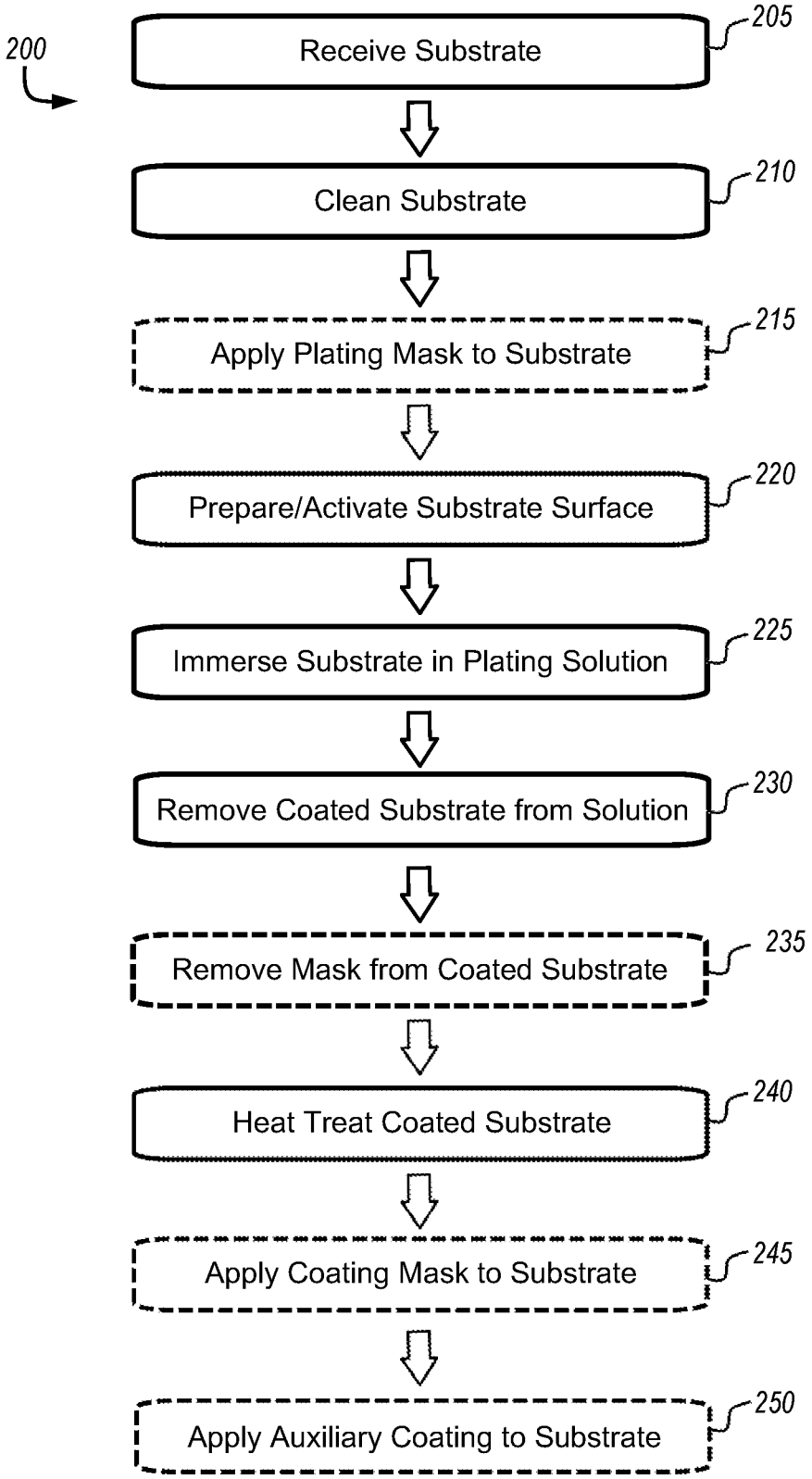
FIG. 2 is a flowchart of an exemplary method for coating a surface of a substrate with a metallic coating deposited from the metal plating solution prepared by the exemplary method of FIG. 1.

Referring to the figures, FIG. 1 illustrates an example method 100 for producing the metal plating solution. FIG. 2 illustrates an example method 200 for forming a metallic coating on a substrate, using the metal plating solution produced by the method 100 shown in FIG. 1 and a process of electroless plating for depositing the metallic coating. The metallic coating deposited from the metal plating solution on to the substrate includes a first metal from the first source of metal ions, a second metal from the second source of metal ions, phosphorous sourced from the reducing agent of the metal plating solution, and graphene nanoparticles. The method 200 illustrated by FIG. 2 further includes steps 205 through 220 for preparing a substrate prior to depositing the metallic coating, heat treatment at 240 of the coated substrate, and applying an auxiliary coating to the coated substrate at optional steps 245 through 250. By way of non-limiting example, FIG. 3 details the method 240 of applying a heat treatment to the coated substrate. The metal plating solution can also be referred to herein as a plating bath and/or as a plating solution.

In a non-limiting example, the metal of the first source of metal ions is nickel, which can be provided to the metal plating solution as nickel sulfate, nickel chloride, and/or a mixture thereof. In a non-limiting example, the metal of the second source of metal ions is a refractory metal and/or mixture of refractory metals. For example, the metal of the second source of metal ions can be a refractory metal selected from a group consisting of tungsten, rhenium, molybdenum, tantalum, and mixtures thereof. In one example, the metal of the second source of metal ions is tungsten, which is advantaged by a more affordable cost, for example, relative to rhenium, due to a wider range of stable supply of tungsten worldwide. In a non-limiting example, the reducing agent includes sodium hypophosphite, which in the electroless plating solution reacts with the first and second sources of metal ions to deposit ultra-fine metal phosphorous crystallites on the surface of a substrate immersed in the plating solution, to form a metallic coating on the surface of the substrate. The metal plating solution described herein is composed such that, as the bath concentration increases in sodium hypophosphite, the structure of the metal phosphorous coating can change in structure, preventing intergranular corrosion in the metallic coating formed in the substrate. In conjunction with corrosion resistance, the metal phosphorous coating has a multitude of other benefits, including high hardness and hot hardness, high melting temperature, high thermal and electrical conductivity, and a low thermal expansion coefficient.

In one example, the introduction of the second source of metal ions in the form of sodium tungstate into an electroless nickel bath alters the structure of the crystallites deposited in the metallic coating. The sodium hypophosphite reductions with nickel occurring in the plating solution described herein are accompanied by sodium tungstate reductions to create three main crystallite structures in the metallic coating, specifically, nickel phosphorous, nickel tungstate, and nickel phosphorous tungstate, where the phosphorous reduces tungsten preferentially to reducing nickel during forming of the metallic coating. The introduction of these new constituents creates a columnar coating structure. These columnar crystallites formed in the deposited metallic coating substantially improve the corrosion resistance, melting temperature, and hardness of the metallic coating, such that the metallic coating described herein is substantially advantaged by the columnar structure of the refractory crystallites formed therein.

In an illustrative example, the metal coating deposited from the metal plating solution on to a substrate is a multi-material composite comprised of organic and metal elements alloyed together, where the organic materials are phosphorous and carbon in the form of graphene nanoparticles and the metal elements include tungsten and nickel. The size distribution of the graphene nanoparticles is preferably in a range from about 1 nanometer to about 10 nanometers and in a shape that is consistent within the native material of the nanoparticle. By way of example, the graphene nanoparticles include graphene nanoplatelets (GNPs), comprised of stacked layers of graphene having a stack thickness in the range of about 1 to 20 nanometers, or more preferably, having a stack thickness of equal to or less than 4 nanometers. The stack thickness can also be referred to herein as the stack height or particle height. The size of the graphene nanoparticles, defined for example, by a particle width or particle diameter, is preferably in the range of about 1 to 20 nanometers, or more preferably in the range of about 1 to 10 nanometers.

Each metal is supplied in a metal salts form or another form donating the appropriate metal ions to the plating bath. In a non-limiting example, the source of nickel ions in the metal plating solution is one of nickel chloride and nickel sulfate, and the source of tungsten ions is sodium tungstate. In the metallic coating, the constituent components can range in percent by weight composition. For example, the graphene nanoparticles are present in the metallic coating in a percent by weight composition ranging from 0.01% to 5.0% by weight, with a preferable range between 0.05% and 1.5% by weight of the metallic coating, and in a more preferable range between 0.05% and 0.25% by weight of the metallic coating. The phosphorous is present in the metallic coating in a percent by weight between 1.0% and 15.0%, with a preferable range between 1.0% and 6.0% by weight of the metallic coating. Tungsten is the second most prevalent material within the deposited metallic coating, with a percent by weight composition between 1.0% and 40.0%, and a preferable range between 1.0% and 20.0%. The most prevalent material within the deposited metallic coating is nickel, which comprises the remainder of the 100% by weight composition of the coating. For example, nickel can be present in the deposited metallic coating in a range between about 30% and 97.99% by weight of the metallic coating.

Referring to FIG. 1, shown is an example method 100 for producing the metal plating solution described herein. The metal plating solution, to be used for electroless plating of a substrate to deposit the metallic coating described herein, requires multiple sources of metal ions and reactive organic materials to form varying alloy grains. Phosphorous is typically added to the solution as the reducing agent, in the form of sodium hypophosphite. The metal plating solution must be heated to an operating temperature ranging between about 170 to 210 degrees Fahrenheit (77 to 99 degrees Celsius). In a non-limiting example, the pH of the metal plating solution is controlled within a range between 2 and 10, is controlled preferably to a pH between 4 and 9, and most preferably, to a pH of 9 or about 9. The pH of the metal plating solution can be controlled in a multitude of ways, with the preferred method being the addition of ammonium to the metal plating solution.

The purity of the nickel metal ions added to the metal plating bath, in a non-limiting example, is in a range between 97% and 100%, with a preferable purity of at least 99.9%, and with a more preferable purity of 99.99%. These nickel metal ions can be added in a variety of forms, with the preferable being nickel sulfate. Tungsten metal ions, of similar purity ranges, can be added in a variety of forms, with the preferable being sodium tungstate.

By way of a non-limiting example, additional sources of metal ions can be added to the metal plating solution, such that the metals of these additional sources are included in the metallic coating deposited from the metal plating solution. These additional sources of metal ions can be added to promote the formation of the metallic coating deposit and/or to enhance and/or contribute to certain properties and/or characteristics of the metallic coating deposit. In one example, at least one of molybdenum or rhenium can be added to the metal plating solution and be deposited to the metallic coating to modify, for example, increase, the hardness of the deposited alloys and/or the melting temperature of the metallic coating. In one example, boron can be added to the metal plating solution and be deposited to the metallic coating, to act as a binder in the metal plating bath, and to contribute to increased smoothness of the resulting metallic coating deposit. In one example, boron can be added to the metal plating bath in the form of boron hydride metal salts having a particle size at 100 mesh, e.g., equal to or less than 100 mesh. and at a concentration of 20 grams per liter (g/l).

Graphene-based carbon nanoparticles are added to the metal plating solution in a form selected from a group consisting of graphene nanoplatelets, graphene oxide, or functionalized carbon tubes, or mixtures thereof. In a preferred example, graphene nanoplatelets are added to the plating solution, where the graphene nanoplatelets are non-terminated graphene nanoplatelets, terminated graphene nanoplatelets, and/or a mixture thereof.

By way of non-limiting example, the use of terminated graphite nanoplatelets is preferred as providing advantages to the metal plating process described herein. For example, terminated graphite nanoplatelets have a residual charge which allows the nanoplatelets to disperse within the metal plating solution preventing agglomeration of the nanoplatelets in the metal plating solution and creating a more uniform deposit structure. Advantageously, preferred termination of the graphite nanoplatelets creates a positive electrical potential which prevents precipitation within the metal plating solution of metal cations, and as such, prevents coagulation of the precipitated metal cations within the metal plating solution. If allowed to occur, the coagulation and agglomeration of these precipitants can result in a tremendous loss in efficiencies of the plating process, and can result in an unstable metal plating solution. As such, the inclusion of terminated graphite nanoplatelets in the metal plating solution to prevent precipitation of metal cations in the solution is advantageous. Additionally, terminated graphitic nanoplatelets with positive charge bias support bonding to the solutions metal cations.

By way of non-limiting example, any termination providing a net electrical charge on the graphene nanoparticles is usable within the described methods, metal plating solution, and metallic coating. Non-limiting examples of forms of termination which can be used to produce terminated graphene nanoparticles include the attachment of carboxylic acids (COOH), dinitrogen (N2), amino radical (NH2), fluorine (F), oxygen (O+), and silicon (SI), with any functional group developing a net positive zeta potential, including O+, being preferable, such that the terminated nanoparticles exhibit a positive net zeta potential in the metal plating solution. In a non-limiting example, the nanoparticle size distribution is between 1 and 20 nanometers, with the preferred size distribution between 2 and 10 nanometers. The graphene nanoparticles can be delivered to the metal plating solution in either a dry powder form or suspended in solution, with the preferred method being suspended in an aqueous dispersing agent.

Referring to FIG. 1, shown is an example method 100 for producing a metal plating solution as described herein. At 105, a base solution is prepared, which in a non-limiting example is an electroless nickel plating bath as is known in the art. In an illustrative example, a nickel plating bath such as a Meta-Plate electroless nickel (EN) plating bath sold by Metal Chem, Inc., can be used. The base solution includes a first source of metal ions, which in the present example are nickel ions, and further includes a reducing agent including phosphorous, which can be included in the base solution in the form of sodium hypophosphite.

At step 110, a second source of metal ions is added to the base solution, where the metal of the second source of metal ions includes one or more refractory metals. The concentration of the second source of metal ions in the metal plating solution is about 60 g/l. The particle size of the refractory metal is preferred at 100 mesh, e.g., equal to or less than 100 mesh. In a preferred example, the refractory metal particles have a spherical shape. In one example, the refractory metal particles are prepared using molten gas atomization to provide particles which are substantially spherical. As previously described, the refractory metal in a preferred example is tungsten.

Optionally, at step 115, one or more additional sources of metal ions such as boron, molybdenum, rhenium and/or mixtures thereof can be added to the bath, as previously described herein.

At step 120, graphene nanoparticles are added to the base solution, where in a preferred example, the graphene nanoparticles are graphene nanoplatelets, also referred to herein as graphite nanoplatelets. The concentration of graphene nanoplatelets in the metal plating solution is in a range of 0.01 grams/liter (g/l) to 5 g/l, and preferably about 0.05 g/l. In a preferred example, the graphene nanoplatelets are terminated and exhibit a positive zeta potential. The base solution including the source of nickel ions and phosphorous, the source of refractory metal ions, such as tungsten, additional metals if added, and graphene nanoparticles, is thoroughly mixed such that the constituents of the solution are uniformly dispersed to produce the metal plating solution.

The metal plating solution, at step 125, is loaded into the plating equipment at ambient temperature, and at step 130, is heated to an operating temperature in the range of 185 to 190 degrees Fahrenheit (85 to 88 degrees Celsius). In an alternative method, the plating solution can be prepared directly in the plating equipment such that the equipment can support this process. The pH of the metal plating solution is measured and adjusted as needed, for example, by the addition of ammonium, to a pH range of 2 to 11, or preferably, to a pH range of 4 to 9 with a target pH of 9. In use, the operating temperature, pH and composition of the metal plating solution are periodically measured and/or monitored, and adjustments are made as needed to maintain the operating temperature, pH, and composition of the metal plating solution, including, for example, the concentrations of metal ions and graphene nanoparticles in the solution, within the ranges described herein.

Referring now to FIG. 2, shown is an exemplary method 200 for coating a surface of a substrate with a metallic coating deposited from the metal plating solution prepared by the exemplary method of FIG. 1. A substrate, as that term is used herein, refers to any object having a surface onto which a coating can be deposited from the metal plating solution disclosed herein. A substrate can include, by way of non-limiting example, a sheet of material, a component part, an assembly, etc. The substrate can be made of one or more of a metal-based material, a non-metallic material, a polymer, a ceramic, and/or a combination thereof. In one example, the substrate includes and/or is made of a metal-based material, wherein the metal-based material is selected from a group comprising iron, aluminum, magnesium, titanium, zinc, copper, nickel, chromium, trace elements, and mixtures thereof. In one example, the metal-based material is a steel alloy. In one example, the steel alloy is comprised of iron, carbon, chrome, molybdenum, and vanadium along with other elements and trace elements. In one example, substrates made of iron-carbon-chrome-molybdenum-vanadium steel alloys have been coated using the metal plating bath and methods described herein.

Referring to FIG. 2, the method 200 includes a step 205 for receiving and inspecting the substrate, for example, to determine whether cleaning of the substrate is required at step 210, prior to immersion of the substrate in the metal plating solution. At step 210, if required, the substrate undergoes a cleaning process, where the cleaning method used will depend on the material from which the substrate is made, the condition of the substrate, and the nature of any materials to be cleaned or removed from the substrate. In an illustrative example, the substrate may be made from a metal-based material, such as steel, to which a protective coating and/or corrosion resistant agent, such as a protective oil or other corrosion inhibiting material has been applied to prevent corrosion of the substrate, for example, during transport of the substrate to the coating facility. The cleaning method selected will depend on the type of the metal-based material and the type of the protective coating to be cleaned from the substrate. For example, a degreasing agent can be used to remove protective oil from a steel surface. For example, the cleaning method can be selected to accomplish cleaning of the substrate without toxification of the substrate material.

As shown at step 220, preparation of the substrate for coating can include preparing and/or activating the surface upon which the coating will be deposited from the metal plating bath. Preparing the substrate surface can include, for example, removal and/or etching of an oxide layer on the surface of the substrate, to activate the substrate surface for receiving the deposited metallic coating. For example, the preparation and/or activation method can be selected to accomplish this step without toxification of the substrate material.

At optional step 215, a plating mask or masking material can be applied to one or more portions of the surface of the substrate, prior to immersion of the substrate in the metal plating solution at 225. The plating mask and/or masking material is applied to an unplated portion and is configured such that the unplated portion remains unplated, e.g., is shielded or masked from receiving a deposit of the metallic coating on the masked portion of the surface. In one example, a masking material can be selectively applied to the portion of the substrate to be masked, for example, by painting, spraying or otherwise applying the masking material to the selected portion to form the plating mask, prior to immersing the substrate in the plating bath. In one example, the plating mask can be configured to be selectively attached to the substrate such that when attached, the plating mask shields the masked portion from receiving a deposit of the metallic coating when the substrate is immersed in the metal plating bath. For example, the plating mask can be configured as a cap, sleeve, cover, etc. which can be fitted to and/or selectively attached to the masked portion of the substrate. In one example, the plating mask is configured to be reusable, such that the plating mask can be selectively attached to the substrate prior to coating the substrate in the metal plating bath, removed from the unplated portion of the substrate after the substrate has been removed from the metal plating bath, and reapplied to another substrate. The example shown in method 200 is non-limiting, such that the masking step 215 can occur at various points in the process, for example, after step 220, prior to step 210, etc., depending on the configuration and composition of the substrate, the surface(s) to remain unplated, etc.

At step 225, the cleaned and/or activated substrate, including the plating mask, if applicable, is immersed in the metal plating solution for a period of plating time as required to deposit the metallic coating on the substrate at a desired thickness. The metal plating solution can be prepared as described herein, and/or as illustrated by method 100 shown in FIG. 1. Deposition of the metallic coating on the substrate, as previously described, can include deposition of crystallite structures including, for example, crystallite structures comprised of nickel, tungsten, phosphorous, graphene and mixtures thereof. In one example, the crystallite structures formed in the metallic coating can include columnar structures which can contribute, for example, to the stability, strength, and/or wear resistance of the deposited metallic coating. After immersion in the plating solution for the desired plating time, the coated substrate is removed from the plating solution at step 230. In one example, step 230 can include rinsing residual plating solution from the coated substrate after removal from the plating solution, by means appropriate to the composition and configuration of the coated substrate, which can include, for example, immersion of the coated substrate in a rinsing bath, or spray rinsing of the coated substrate. If a plating mask has been applied, the plating mask is removed at step 235. In one example, a plurality of substrates can be processed through the method 200 as a batch, including, for example, concurrently immersing multiple substrates into the metal plating solution, using fixturing and/or tools designed for that purpose.

Figure 3:
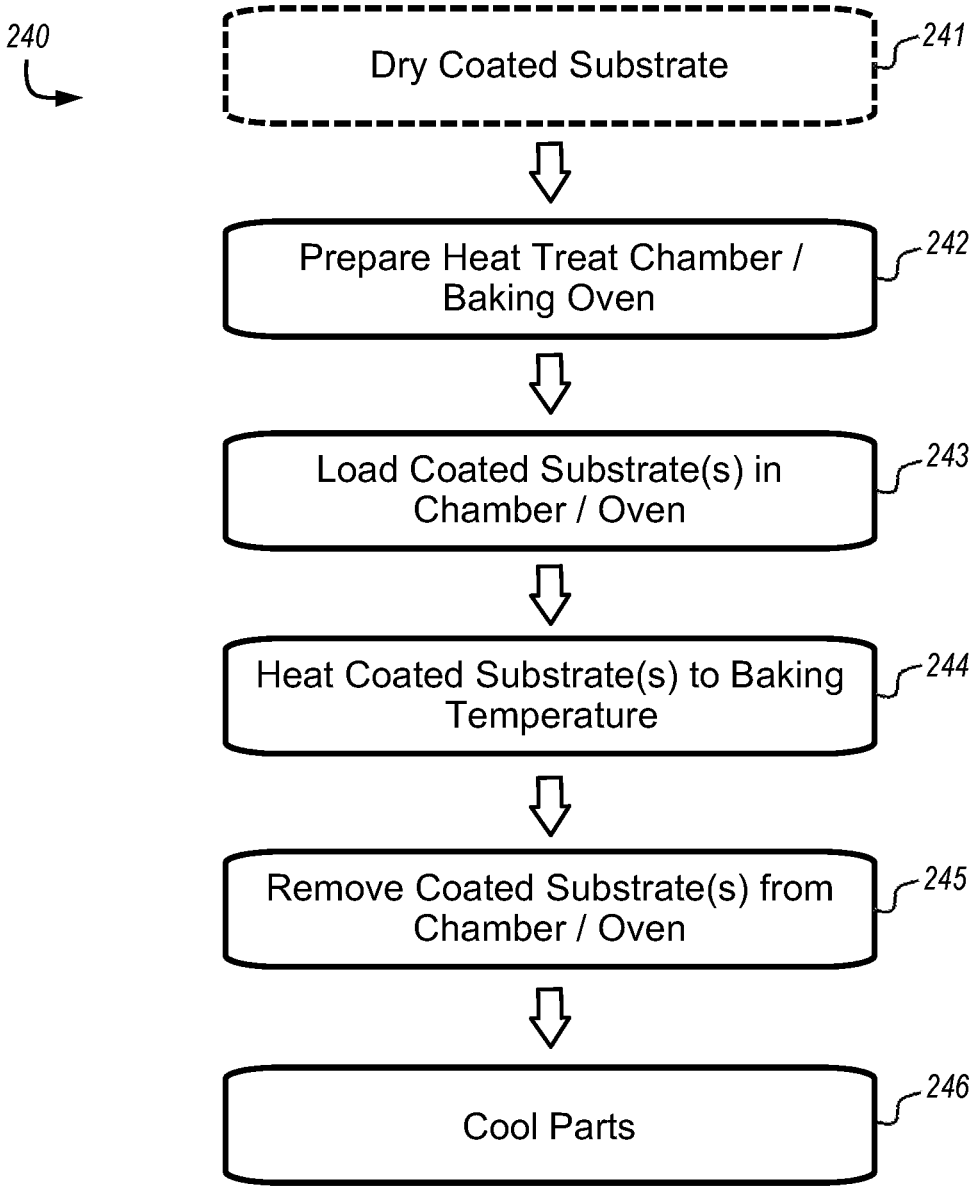
FIG. 3 is a flowchart of an exemplary method for heat treatment of the coated substrate plated using the exemplary method of FIG. 2.

At step 240, a heat treatment can be applied to the coated substrate and/or to the batch of coated substrates. FIG. 3 illustrates an example heat treatment in additional detail. As shown in FIG. 3, at option step 241 the coated substrate can be subjected to a drying step, for example, to dry any residual plating solution, rinsing solution, and/or moisture from the coated substrate prior to loading the coated substrate into the heated chamber. The drying step can include, for example, air drying the coated substrate using ambient and/or pressurized air. At step 242, a heat treatment chamber, also referred to herein as a baking oven which in an illustrative example can be configured as an industrial oven or furnace, is prepared by preheating the heat treat chamber to a baking temperature in the range of about 93 to 1022 degrees Fahrenheit (200 to 550 degrees Celsius), where the baking temperature is selected based on one or more factors including the composition of the substrate, the cycle time of the baking cycle, the desired post-heat treatment grain structure in the metallic coating, and the susceptibility of the coated substrate to heat distortion or deformation. The minimum baking cycle time is the time required to uniformly heat the plated coating to the baking temperature and hold for a minimum cycle time predicated by the target temperature. The baking temperature and cycle time can be adjusted to precipitate new grain structures in the metallic coating, to optimize mechanical properties of the metallic coating including hardness and wear resistance. The cycle time can be increased for lower baking temperatures, for example, to achieve the desired grain structure in the metallic coating while minimizing heat distortion of the substrate. In one example, the atmosphere in the heat treat chamber is ambient air. In a preferred example, a protective atmosphere is maintained in the heat treat chamber, which can be, for example, argon gas. In one example, a batch of coated, e.g., plated, substrates are positioned in the heat treat chamber such that each plated substrate is spatially separated in the chamber from each other plated substrate of the plurality of plated substrates, for example, by fixturing or position, to provide uniform heating of each of the plated substrates in the chamber.

At steps 245 and 246, the baked coated substrate is removed from the heat treat chamber and cooled. In one example, the baked coated substrate is cooled in air. In a preferred example, the substrate is cooled in a protective environment such as in argon gas, where in the latter example, the substrate can be cooled in the baking chamber and/or in a cooling chamber in which the atmosphere can be controlled. The example of step 240 is non-limiting, and it would be understood that heat treatment of the coated substrate can be optional. In this case, the metallic coating will exhibit mechanical properties determined by the structure of the metallic coating as deposited on the substrate from the metal plating solution.

Referring again to FIG. 2, at steps 245 and 250, an auxiliary coating can be applied to the plated substrate, where the auxiliary coating can be applied, for example, to an unplated portion of the substrate surface, to the entire substrate surface, to the plated surface, and/or to a combination of the unplated and plated portions of the surface, where the type of auxiliary coating, the surface or surface portion of the plated substrate to which the auxiliary coating is applied, and the method of application are dependent on the requirements of the finished substrate. In one example, the auxiliary coating can be selected from a group consisting of a liquid paint, a conversion coating, an organic coating, and an electrophoretic deposition coating (e-coating). In one example, multiple auxiliary coatings can be applied, either as a single layer in selected portions of the surface of the substrate or as layered coatings on the substrate and/or on the metallic coating, and/or in various and/or selected portions of the surface of the substrate, to provide functional and/or decorative characteristics and/or properties to the substrate.

In a non-limiting example, the unplated portions of the substrate may be coated with an organic coating, such as a liquid paint or e-coat, for appearance, emittance, wear, scratch resistance, corrosion protection, etc., or other affects. In one example, the plated portions of the surface can be masked, by applying and/or attaching a coating mask to the plated portions, to prevent the application of the auxiliary coating to the plated portion. The coating mask is removed after application of the auxiliary coating, to provide a finished substrate. The coating mask can be configured as a reusable mask, for example, as a cap, sleeve or other cover, or as a stencil mask for applying an auxiliary coating in a stenciled pattern. The examples provided herein are non-limiting and illustrative.

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. The appended claims, in their entirety, are incorporated by reference into this description, such that the various alternative designs and embodiments defined in the appended claims should be considered supplementary to that of the present description. Further, while only certain representative materials and method steps disclosed herein are specifically described, other combinations of the materials and method steps also are intended to fall within the scope of the appended claims, even if not specifically recited. Thus, a combination of steps, elements, components, or constituents and observations derived therefrom may be explicitly mentioned herein; however, other combinations of steps, elements, components, and constituents and observations derived therefrom are included, even though not explicitly stated.

When an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the presently disclosed subject matter be limited to the specific values recited when defining a range.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

I claim:

1. A metallic coating comprising, by weight, 1.0% to 40.0% of an alloying metal selected from a group consisting of niobium, tantalum, and mixtures thereof, 1.0% to 20.0% of phosphorous, 0.01% to 5.0% of graphene nanoplatelets having a net positive zeta potential, and a remainder of nickel.

2. The metallic coating according to claim 1, wherein the alloying metal is niobium.

3. The metallic coating according to claim 1, wherein the alloying metal is tantalum.

* * * * *